US005575349A

United States Patent [19]

Ikeda et al.

[11] Patent Number: 5,575,349

[45] Date of Patent: Nov. 19, 1996

[54] SOUNDPROOF TYPE WATER-COOLED ENGINE GENERATOR

[75] Inventors: Takatoshi Ikeda; Toshiaki Tanaka; Sanpei Sato, all of Kosei-Cho, Japan

[73] Assignee: Denyo Kabushiki Kaisha, Tokyo-To, Japan

[21] Appl. No.: 323,879

[22] Filed: Oct. 17, 1994

[30] Foreign Application Priority Data

Oct. 19, 1993 [JP] Japan ..... 5-056350 U

[51] Int. Cl.[6] ..... B60K 11/00

[52] U.S. Cl. ..... 180/68.1; 180/296; 180/68.4; 180/89.2; 181/204; 123/41.7

[58] Field of Search ..... 180/296, 68.1, 180/68.2, 68.4, 69.2, 69.24, 89.2; 181/204, 224; 123/41.7

[56] References Cited

U.S. PATENT DOCUMENTS

| | | | |
|---|---|---|---|
| 2,913,065 | 11/1959 | Lyon, Jr. | 180/68.1 |
| 3,666,042 | 5/1972 | Cederbaum | 181/204 |
| 3,696,730 | 10/1972 | Masuda et al. | 180/68.1 |
| 3,989,415 | 11/1976 | Van-Hee et al. | 417/312 |
| 4,241,702 | 12/1980 | Takeuchi et al. | 123/41.7 |
| 4,629,031 | 12/1986 | Kato et al. | 181/204 |
| 4,696,361 | 9/1987 | Clark et al. | 180/68.1 |
| 4,738,327 | 4/1988 | Takei | 180/69.24 |
| 4,854,278 | 8/1989 | Honecker | 181/204 |
| 4,891,940 | 1/1990 | Tamba et al. | 180/68.1 |
| 4,940,100 | 7/1990 | Ueda | 180/68.1 |
| 5,113,819 | 5/1992 | Murakawa et al. | 180/68.1 |
| 5,207,187 | 5/1993 | Kurohara et al. | 180/68.1 |

FOREIGN PATENT DOCUMENTS

| | | | |
|---|---|---|---|
| 1208482 | 6/1958 | France . | |
| 1295586 | 4/1961 | France . | |
| 2378646 | 12/1977 | France . | |
| 4-159181 | 6/1992 | Japan | 180/89.2 |
| 4-257735 | 9/1992 | Japan | 180/68.1 |

*Primary Examiner*—Anne Marie Boehler
*Assistant Examiner*—Min Yu
*Attorney, Agent, or Firm*—Jacobson, Price, Holman & Stern, PLLC

[57] ABSTRACT

A soundproof type water-cooled engine generator is constructed to guide an exhaust current of air from a cooling fan of a water-cooled engine to an independent hood-like shroud chamber, deaden the current sound through a muffler located under the shroud chamber, for improving the cooling performance. A water-cooled engine 2 and a generator 3 are accommodated in a soundproof bonnet 1. A panel wall 8 is provided close to a fan 7 equipped in the water-cooled engine. The panel wall serves to partition the soundproof bonnet 1 into an engine and generator chamber 11 and an exhaust processing chamber 12. The panel wall has a hole having the substantially same diameter as the fan 7. Around the outside of the hole, a shroud chamber 17 is independently provided in the exhaust processing chamber. The shroud chamber 17 is formed by a hood-like encircling wall 14. On the lateral side of the shroud chamber, a radiator 13 is located to stand upright. A muffler is located under an exhaust duct chamber 18 so that the exhaust is discharged from the upper portion of the exhaust duct chamber.

3 Claims, 2 Drawing Sheets

SOUNDPROOF TYPE WATER-COOLED ENGINE GENERATOR

BACKGROUND OF THE INVENTION

1. Field of the Invention

The present invention relates to a soundproof type water-cooled engine generator which provides such a low-noise structure as improving soundproof performance and cooling efficiency.

2. Description of the Related Art

The conventional cooling structure for this kind of soundproof type water-cooled engine generator, as shown in FIG. 3, includes a water-cooled engine 41, a generator 42, and a soundproof bonnet 43. The water-cooled engine 41 is directly connected to the generator 42 so that they keep their axes aligned. The water-cooled engine 41 and the generator 42 are accommodated in the soundproof bonnet 43. Air inlets 44, 44, 44 are formed on the side wall of the bonnet 43. Those inlets are located close to the generator accommodated in the soundproof bonnet 43. On the opposite side of the water-cooled engine 41 to the generator 42, an engine fan 45 is supported on a shaft contained in the water-cooled engine 41 so that the engine fan 45 is rotated by the engine 41. As opposed to the engine fan 45, a radiator 46 is located. The engine fan 45 is surrounded by an encircling wall 47.

In operation, the engine fan 45 is driven to take air, that is, cooling air from the air inlets 44 to the soundproof bonnet 43. The cooling air is taken inside to cool the generator 42, the water-cooled engine 41, and then the other units such as a battery and a control unit. Then, the air is introduced to an exhaust duct 48 for cooling a muffler located upwardly of the exhaust duct 48. The air is then discharged outside through an exhaust outlet 50. The exhaust duct 48 is formed by partitioning the soundproof bonnet 43 from the shroud chamber where the water-cooled engine 41, the generator 42 and the control unit are held.

Further, another soundproofing and cooling technique has been provided. In this technique, a shroud chamber is independently provided in the exhaust duct 48. A radiator is slopewise located in the front lower portion of a cooling fan provided in the shroud chamber so that the engine fan is spaced from the radiator by a predetermined interval for diminishing a current noise occurring in this radiator.

In the foregoing structure where the radiator is located as opposed to the engine fan, the engine fan is located close to the radiator. Hence, the current noise caused when the cooling current of air given by the engine fan passes through a radiator core is made so large that the noise is guided out of the exhaust outlet through the exhaust duct. The noise guided outside sounds as a large uncomfortable sound around the structure. In particular, such a large sound annoys residents in an apartment house when the engine fan is operated at night.

Moreover, to meet the market demands, the soundproof bonnet is requested to be reduced in size. This leads to reducing the lengthwise dimension of the structure. However, if the front dimension of the radiator is made shorter as keeping the conventional structure, disadvantageously, the resistance against the exhaust current of air is made so large that the cooling performance does not reach the satisfactory level.

As another disadvantage, since the muffler is located upwardly of the exhaust duct without any cover, the muffler serves to directly apply heat to the radiator, thereby lowering the cooling efficiency of the radiator.

In the aforementioned structure where the shroud chamber is independently provided in the outlet of the engine fan and the radiator is simply inclined, the following disadvantages take place. At first, water is reserved in the lower portion than a drain so that water is not allowed to be completely drained out of the radiator. Hence, the radiator holds the air reservoir in the top portion so that the water flow in the radiator is made slow. Second, since the radiator is slopewise located downwardly of the shroud chamber, dirt and oil are likely to adhere to the surface of the radiator core. Third, since the radiator provides its cap in the top, the user needs to take a troublesome operation of pouring water in the radiator.

SUMMARY OF THE INVENTION

It is an object of the present invention to provide a soundproof type water-cooled engine generator which includes such a low-noise structure as improving soundproof performance and cooling performance.

To achieve the foregoing object, a soundproof type water-cooled engine generator having a water-cooled engine, a generator to be driven by the water-cooled engine, and a soundproof bonnet accommodating the engine and the generator and arranged so that a cooling fan generates a cooling current of air passing around the cooling engine and the generator and exhausting to the outside through a radiator and around a muffler, provides an engine and generator chamber for accommodating the engine and the generator, the chamber provided in the soundproof bonnet; an exhaust processing chamber for accommodating the radiator and the muffler, the chamber provided in the soundproof bonnet; a panel wall having an air vent for a cooling current of air generated by the cooling fan and partitioning the engine and generator chamber from the exhaust processing chamber; a radiator provided to keep a predetermined angle with the panel wall in order to disallow the cooling current of air passing through the air vent to collide with the radiator; a shroud chamber having a ventilation path formed to guide the cooling current of air from the air vent to the radiator, the shroud chamber provided in the exhaust processing chamber; and a muffler provided to pass the cooling current of air from the radiator around the muffler itself, the muffler provided in the exhaust processing shroud chamber.

In the aforementioned arrangement, the rotation of the cooling fan causes the atmosphere to be flown from an air inlet formed on the side wall to the engine and generator chamber for cooling the generator and the water-cooled engine. The air is sent to the L-like shroud chamber independently provided in the exhaust processing chamber. Then, the air is passed to the radiator located on the lateral side and exhausted out of the chamber. The exhaust current is directed lower between the outer surface of the shroud chamber and the inner surface of the exhaust processing chamber for cooling the muffler located in the lower of the exhaust processing chamber. The exhaust current streams along the peripheral surface of the muffler and the muffler pipe. The resulting heated air is discharged through the exhaust duct provided on the ceiling of the exhaust processing chamber. The noises occurring in the engine and generator chamber are shielded by the panel wall. The exhaust current brings the noises into the shroud chamber. The noises are temporarily cut off by the shroud chamber and the radiator independently provided in the exhaust processing chamber. Besides, the current of air is got out of the ceiling through the muffler provided in the lower portion of the shroud chamber and the exhaust duct. Hence, a lot of obstacles serve to diminish the noises leaked to the outside.

DESCRIPTION OF THE PREFERRED EMBODIMENTS

Figure 1:
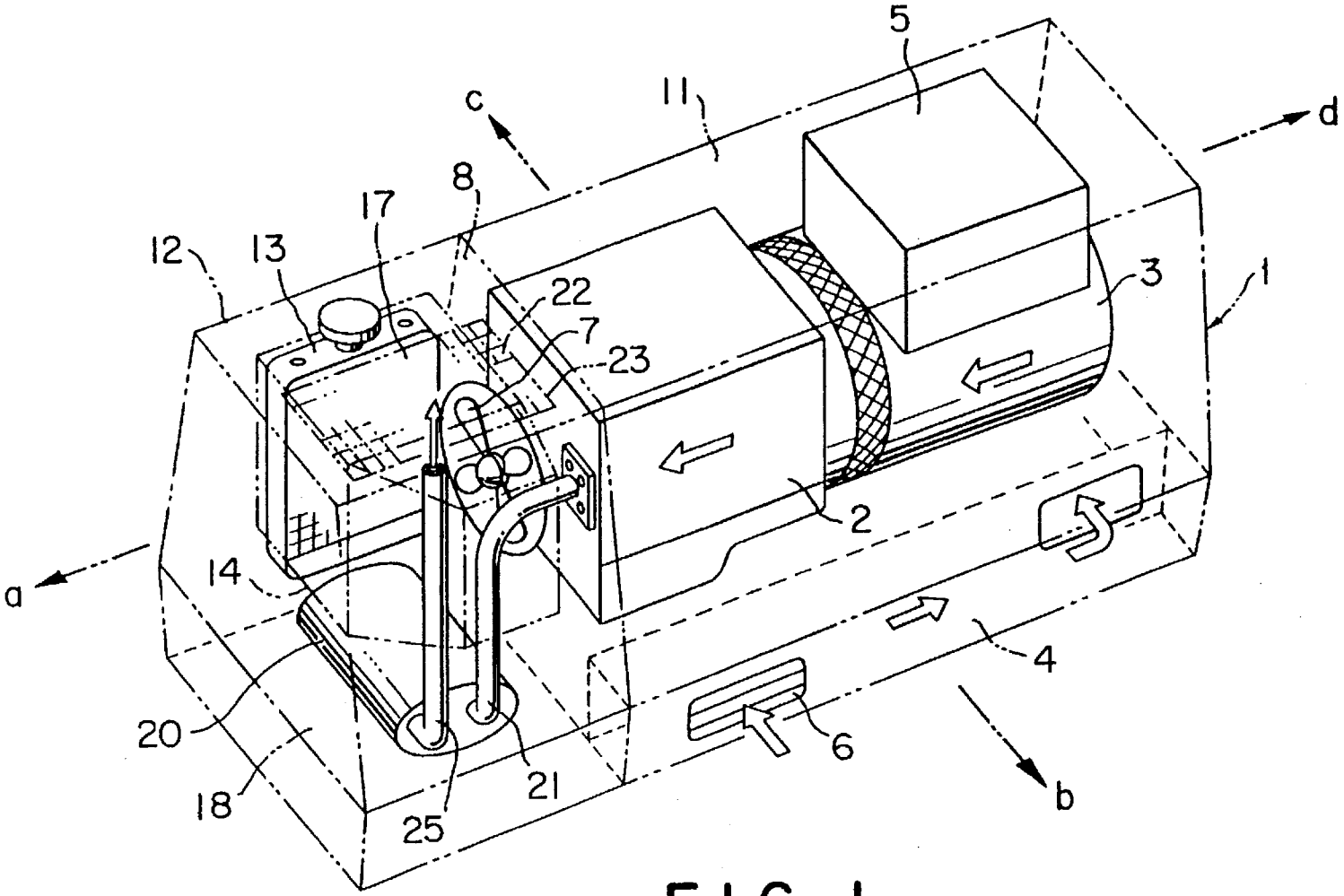
FIG. 1 is a perspective view showing a low-noise structure of a soundproof type water-cooled engine generator according to an embodiment of the present invention.
Figure 2A:
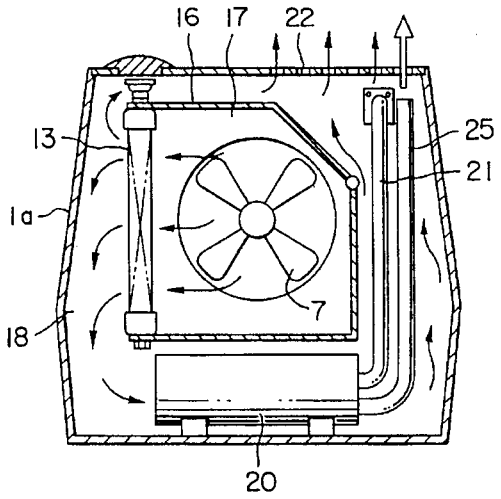
FIG. 2A is an elevation showing an essential portion of the low-noise structure of the soundproof type water-cooled engine generator according to the embodiment of the invention.
Figure 2B:
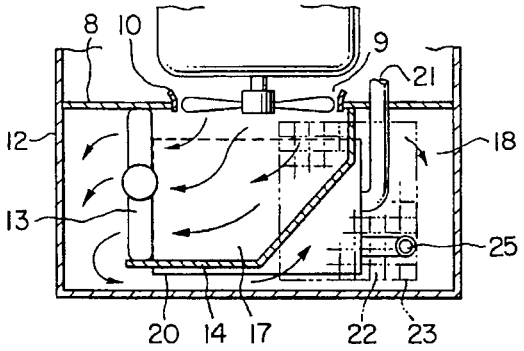
FIG. 2B is a plane view showing an essential portion of the low-noise structure of the soundproof type water-cooled engine generator according to the embodiment of the invention.
Figure 3:
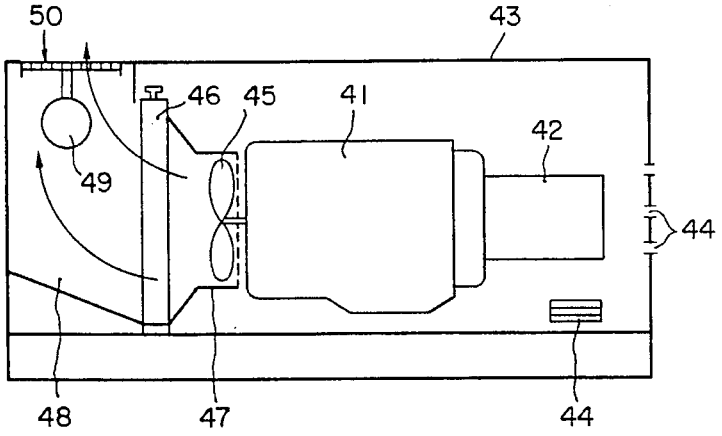
FIG. 3 (PRIOR ART)
FIG. 3 is a plane view showing the conventional low-noise structure of a soundproof type water-cooled engine generator.

FIG. 1 is a perspective view showing a low-noise structure of a soundproof type water-cooled engine generator according to an embodiment of the present invention. FIG. 2A is an elevation showing an essential portion of the low-noise structure of the soundproof type water-cooled engine generator according to the embodiment of the invention. FIG. 2B is a plane view showing an essential portion of the low-noise structure of the soundproof type water-cooled engine generator according to the embodiment of the invention, and FIG. 3 is a plane view showing the conventional low-noise structure of a soundproof type water-cooled engine generator.

Hereafter, an embodiment of the invention will be described with reference to the drawings.

A soundproof bonnet 1, as shown in FIG. 1, accommodates a water-cooled engine 2 and a generator 3, both of which are directly connected so that they keep their axes aligned. In the lower portion of the soundproof bonnet 1, there is provided a base 4, on which the water-cooled engine 2 and the generator 3 are placed. Below the generator, a fuel tank 5 is located. An air inlet 6 is formed on each side wall of the soundproof bonnet 1. The air inlet 6 is located in the lower portion of each side wall. On the opposite side to the generator 3 of the water-cooled engine 2, a fan 7 is provided. A panel wall 8 stands nearby the fan 7 so that the fan 7 is located in the hole of the panel wall 8. The hole has the substantially same diameter as the fan 7. On the inner surface of the hole of the panel wall 8 (referred simply to as inlet), a guide 10 is secured. The guide 10 is formed to be projected toward the water-cooled engine 2. The part of the soundproof bonnet sectioned by the panel wall 8 functions as an engine and generator chamber 11, which accommodates the water-cooled engine 2, the generator 3, the fuel tank 5, a battery for starting the engine, and a control unit. The other sectioned part of the soundproof bonnet functions as an exhaust processing chamber 12.

In turn, the exhaust processing chamber 12 will be described in detail with reference to FIGS. 1 and 2.

On the exhaust side of the fan 7, a radiator 13 stands along the lateral side of a shroud chamber 17 located inside of the exhaust air processing chamber 12. Around the inlet 9 of the panel wall 8, a hood-like encircling wall 14 is provided in a manner to guide the exhaust current from the fan 7 to the radiator 13. The radiator 13 is secured on the side of the encircling wall 14 by a bolt 15 in a manner to allow the radiator 13 to be completely fitted to the lateral opening of the wall 14. The wall 14 and the radiator 13 forms the shroud chamber 17. The outer wall of the shroud chamber and the inner surface of the exhaust processing chamber 12 form an exhaust duct chamber 18.

Under the exhaust processing chamber 12, a muffler 20 is located to extend along the width of the chamber 12. The muffler 20 is connected to one end of an exhaust pipe 21, the other of which is connected to an exhaust port of the water-cooled engine 2 in a manner to penetrate through the panel wall 8.

With the aforementioned construction, as shown in FIGS. 1 and 2, the rotation of the fan 7 causes the outside air to be introduced into the air inlet 6, from which the air is entered into the engine and generator chamber 11 for cooling the engine 3, the water-cooled engine 2, the fuel tank 5, the battery for starting the engine, and the control unit. The current of air then passes through the inlet 9 and the fan 7 and then is discharged to the shroud chamber 17. In this case, the clearance between the fan 7 and the inlet 9 is made as narrow as possible. This makes it possible to effectively send the heated current from the engine and generator chamber 11 to the shroud chamber 17.

The exhaust current, which has been sent to the shroud chamber 17 by the rotation of the fan 7 and heated in the chamber 11 as mentioned above, is guided along the inner surface of the encircling wall 14, that is, an L-like path and reaches the vertically-erected radiator 13. The exhaust current passes through the radiator 13 for cooling it. Then, the exhaust current is guided under the wall 14. The current passes along the wall surface la of the exhaust processing chamber 12. The exhaust current is guided upward along the exhaust pipe 21 as cooling the surface of the muffler 20 located in the lower of the exhaust processing chamber 12 and then reaches the exhaust duct chamber 18. Then, after the current of air serves to effectively cool the exhaust pipe 21 and the muffler exhaust pipe 25, the exhaust current is discharged to the outside through punched holes 22 of the outlet 23.

The heated exhaust air current sent to the shroud chamber 17 is guided along the inner surface of the encircling wall 14 so that the current of air changes its direction and passes along the path. Then, the heated current of air reaches the radiator 13 vertically standing against the lateral side of the shroud chamber 17. In this condition, the shroud chamber 17 is independently located to keep a predetermined distance from the radiator 13 standing upright. This locational arrangement results in greatly diminishing the current noise caused by the core.

Further, the encircling wall 14 independently formed inside of the exhaust processing chamber 12 has an effect on suppressing leakage of the noisy sound of the soundproof type water-cooled engine to the outside.

Moreover, the muffler 20 is located in the lower portion between the shroud chamber 17 and the exhaust processing chamber 12. This locational arrangement prevents the muffler 20 from being directly radiated to the radiator 13. This keeps the cooling efficiency of the radiator constant. Besides, since the current of air is discharged from the exhaust duct 18 as cooling the surface of the muffler 20, the soundproof materials located around the structure is not heated.

A check plate 16 located on the top of the encircling wall 14 is detachable because it is fastened by a bolt. Therefore, by removing only the upper part of the chamber 12, it is possible to check and clean the radiator 13.

As a result of measuring the heat balance and the noise of the engine constructed as above, it indicates that the internal temperature rise of about 5° C. is allowed. As to noises, compared with the conventional structure in which the air noise occurs in the core of the radiator, it indicates that the noise of this embodiment is reduced by 3 dB(A). The noises are measured at the locations a, b, c and d, each of which keeps an interval of about 7 cm from the front, the rear or each side of the soundproof bonnet.

[Noise Data]

| | a (front) | b (left) | c (right) | d (rear) |
|---|---|---|---|---|
| Embodiment | 65 | 65 | 62 | 63 |
| Prior Art | 67 | 68 | 65.5 | 66 |

Unit dB(A)

As set forth above, the low-noise structure of this invention is constructed so that the cooling fan is spaced from the radiator. In comparison with the conventional structure in which the cooling fan is located close to the radiator, the structure of this invention enables to reduce the air noises of the radiator.

Further, the engine and generator chamber is closed by the panel wall and the shroud chamber. The noises of the engine and generator chamber are temporarily cut off by the encircling wall, so that the noise leaked to the outside can be reduced.

The low-noise structure of this invention is constructed so that the radiator stands against the lateral side of the shroud chamber with the shorter side at the top. The exhaust current, therefore, collides against the encircling wall so that the current of air is guided along the lateral side. This makes it possible for the exhaust current to be evenly blown onto the overall surfaces and the peripheral portions of the radiator, thereby improving the cooling efficiency. This results in reducing the longitudinal dimension of the soundproof bonnet, which leads to overall reduction of the soundproof bonnet in size.

Moreover, the muffler is located at a distance from the radiator with the wrap wall laid therebetween. Hence, the direct radiation of the heat from the muffler does not lower the cooling efficiency of the radiator.

What is claimed is:

1. A soundproof water-cooled engine generator comprising:

a water-cooled engine;

a generator to be driven by said water-cooled engine;

a cooling fan connected to said engine for flowing a cooling current of air around said water-cooled engine and said generator;

a radiator arranged perpendicular to said cooling fan and fluidly connected to said water-cooled engine so as to receive cooling water therefrom, for cooling said cooling water using the cooling current of air from said cooling fan;

a shroud chamber having a shroud wall which shifts the cooling current from said cooling fan toward said radiator, provided between said cooling fan and said radiator for guiding the cooling current to said radiator and arranged so as to evenly distribute said cooling current across a front surface of said radiator;

a muffler connected to said water-cooled engine for receiving exhaust from said water-cooled engine, deadening exhaust sound, and discharging the exhaust;

an engine and generator chamber for accommodating said engine and generator;

an exhaust processing chamber for accommodating said radiator and muffler;

a panel wall having an air vent through which the cooling current of air passes to said shroud chamber, wherein the cooling current of air passed through said air vent is guided by said shroud chamber to meet said radiator, said radiator being perpendicular to said panel wall, said panel wall serving to partition said engine and generator chamber from said exhaust processing chamber;

said exhaust processing chamber being provided for forming such a ventilation path as guiding the cooling current of air from said air vent to said radiator in said exhaust processing chamber;

said muffler being provided in said exhaust processing chamber, and said cooling fan moving the flow of air from said radiator to around said muffler.

2. The soundproof water-cooled engine generator according to claim 1, wherein said radiator provided in said exhaust processing chamber is vertically located in a manner that is perpendicular to said cooling fan and wherein said shroud chamber is formed with an opening for the fan at one end of the shroud chamber, and another opening perpendicular to the opening for the fan is located at another end of the shroud chamber to house the radiator.

3. The soundproof water-cooled engine generator according to claim 1, wherein said shroud chamber is located above said muffler.

* * * * *